United States Patent [19]

Röck et al.

[11] 4,188,685

[45] Feb. 19, 1980

[54] MOUNTING PLATE FOR HINGES OR THE LIKE

[75] Inventors: Erich Röck, Höchst; Bernhard Mages, Dornbirn, both of Austria

[73] Assignee: Julius Blum Gesellschaft m.b.H., Hochst, Austria

[21] Appl. No.: 897,163

[22] Filed: Apr. 17, 1978

[30] Foreign Application Priority Data

| | | | |
|---|---|---|---|
| Apr. 15, 1977 | [AT] | Austria | 2639/77 |
| Jun. 10, 1977 | [AT] | Austria | 4098/77 |
| Mar. 24, 1978 | [AT] | Austria | 2122/77 |

[51] Int. Cl.[2] ..... E05D 5/02

[52] U.S. Cl. ..... 16/159; 16/DIG. 22

[58] Field of Search ..... 16/137, 128, 159, DIG. 22; 85/83, 84, 79, 87, 67

[56] References Cited

U.S. PATENT DOCUMENTS

| | | | |
|---|---|---|---|
| 945,403 | 1/1910 | Mohun | 85/67 |
| 3,304,829 | 2/1967 | Raynovich | 85/87 X |
| 3,349,428 | 10/1967 | Suska | 16/128 R |
| 3,386,207 | 6/1968 | Brown | 16/128 R |
| 3,606,814 | 9/1971 | Mackenzie | 85/84 |
| 3,686,709 | 8/1972 | Tuvert | 16/128 R |

FOREIGN PATENT DOCUMENTS

| | | | |
|---|---|---|---|
| 270439 | 4/1969 | Austria | 16/159 |
| 2036565 | 5/1971 | Fed. Rep. of Germany | 16/137 |
| 2457172 | 6/1976 | Fed. Rep. of Germany | 16/159 |
| 1366950 | 6/1964 | France | 85/79 |
| 690033 | 4/1965 | Italy | 16/159 |

*Primary Examiner*—George H. Krizmanich

*Attorney, Agent, or Firm*—Wenderoth, Lind & Ponack

[57] ABSTRACT

Dowels holding a mounting plate, e.g. for furniture hinges, include relatively soft dowel parts and a hard expansion member.

16 Claims, 12 Drawing Figures

MOUNTING PLATE FOR HINGES OR THE LIKE

SUMMARY OF THE INVENTION

The invention relates to a mounting plate or the like, particularly for furniture hinges, having at least one, preferably two dowel parts and one expansion member for each dowel part.

It is the object of the invention to provide a mounting plate with dowels which can easily and quickly be mounted.

According to the invention this is achieved by fastening each expansion member to the mounting plate or by providing that the expansion members are a part of the mounting plate and by constructing the dowel part as separate element with respect to the mounting plate.

It is a further object of the invention to provide a mounting plate that has dowels, e.g. for fastening a hinge, and that gives way from the dowel when the door is opened slightly past an abutment position and that is drawn back again after the strain on the door has ceased. When the plate is forced away from the furniture side wall where it is mounted, the dowel should be spread, whereby it is clamped more securely in a furniture side wall.

According to the invention this is achieved by an expansion member with at least one, preferably two truncated cone sections whose surfaces converge in the extracting direction of the dowel or with sections having at least two lateral faces converging in the extracting direction of the dowel, such sections corresponding to inclined faces on the internal side of the dowel part to be anchored in the furniture part, whereby the dowel part is preferably divided into dowel segments by axial separating slots.

A preferred embodiment is characterized by a projecting ring at the free end of the expansion member. By means of this projecting ring the shock-absorbing portion between the actual dowel part being anchored in the piece of furniture and the expansion member carrying the mounting plate can be limited.

Moreover, it is preferably provided that the projecting ring extends into a recess of the dowel part, such recess being disposed at the front end of the dowel part with respect to the inserting direction, and that the internal surface of the dowel part conically diverges from the recess to the rear end of the dowel part.

A further embodiment of the invention provides that the separating slots are alternately open towards the opposite edges of the dowel part.

In order to secure the dowel segments safely on the expansion member a further embodiment provides that the lateral portions of the dowel segments are provided with plugs and holes into which the plugs are inserted, whereby the holes are preferably disposed on one side and the plugs on the other side of each dowel segment.

Advantageously two dowel segments are connected with each other by a web, the two dowel segments being half a dowel.

Another embodiment provides that the expansion member has lateral projections extending towards the bore wall and into the dowel segments, preferably made of plastics, so that the dowel segments are fixed to the expansion member and that each expansion member is provided with two dowel segments.

BRIEF DESCRIPTION OF THE DRAWINGS

In the following various embodiments of the invention will be described in more detail by means of the drawings, in which.

DESCRIPTION OF THE PREFERRED EMBODIMENTS

Figure 1:
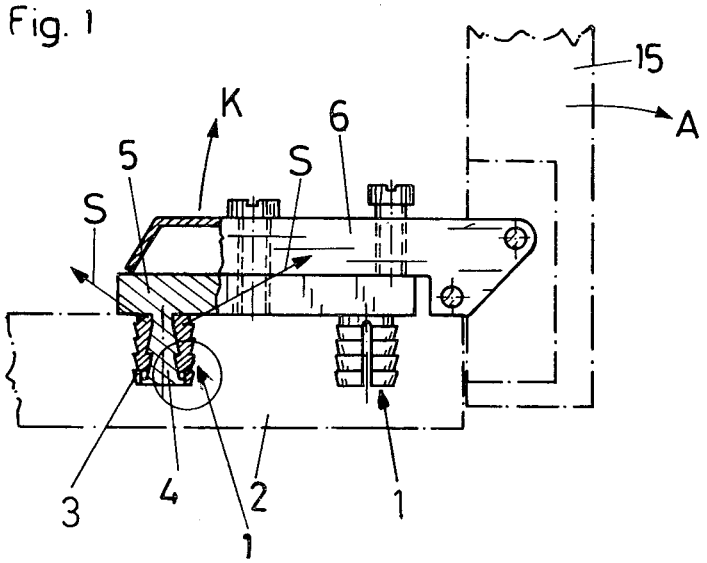
FIG. 1 is a side view of a hinge with a mounting plate according to the invention, wherein parts of the mounting plate and one dowel are shown in section.

As can be seen in FIG. 1, the dowel 1 of a mounting plate 5 comprises a dowel part 3 to be anchored in a part of the piece of furniture, e.g. a side wall 2, and an expansion member 4 which, according to the illustrated embodiment, forms a part of the mounting plate 5 carrying a hinge arm 6.

Figure 1A:
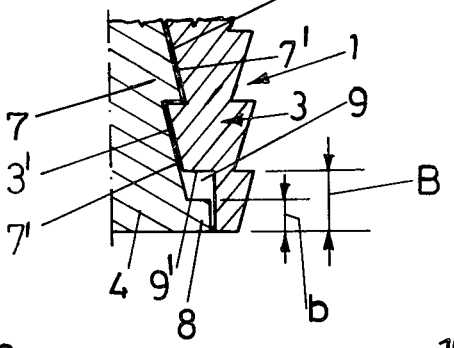
FIG. 1*a* is an enlarged view of the portion within the circle of FIG. 1.

As can also be seen in FIG. 1*a*, the expansion member 4 has truncated cone sections 7 and surfaces 7' corresponding to inclined faces 3' of the dowel part 3.

The free end of the expansion member 4 has a projecting ring 8 extending into a recess 9 of the dowel part 3. The axial height B of the recess 9 is greater than the axial height b of the projecting ring 8.

Figure 2:
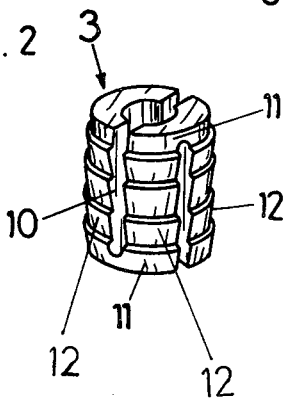
FIG. 2 is a schematic view of a dowel according to the invention.
Figure 3:
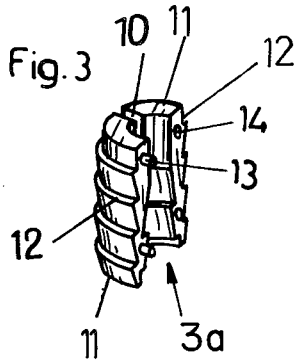
FIG. 3 is a schematic view of half a dowel according to a further embodiment of the invention.
Figure 4:
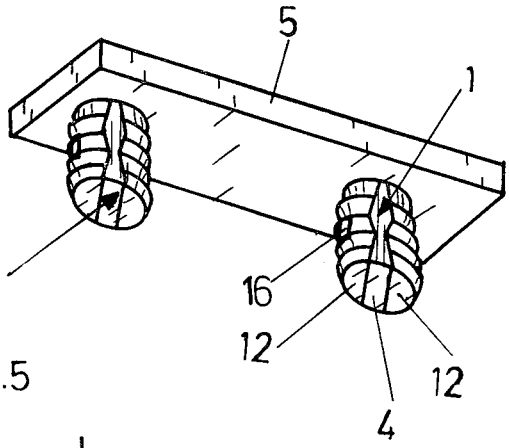
FIG. 4 is a schematic view of a further embodiment of a mounting plate.
Figure 5:
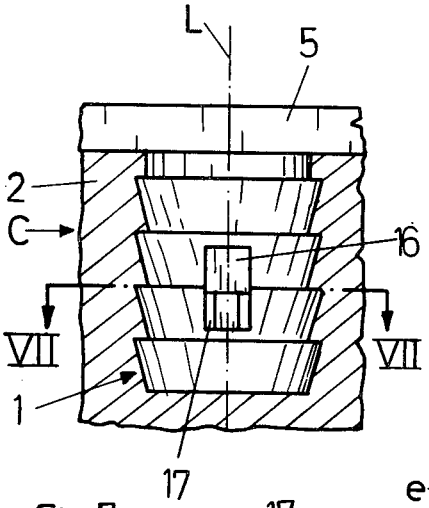
FIG. 5 is a side view of a dowel of a mounting plate according to FIG. 4.

As can particularly be seen in FIGS. 2 and 3, the dowel part 3 is provided with longitudinal slots 10 each being open towards one edge 11 of the dowel part 3. In the embodiment according to FIG. 2 the longitudinal slots 10 are alternately open towards the opposite edges 11.

These longitudinal slots 10 divide the dowel part 3 into separate dowel segments 12. This embodiment facilitates the spreading of the dowel part 3.

The dowel segments 12 can have plugs 13 and holes 14, the plugs 13 of one segment 12 being plugged into the holes 14 of the adjacent dowel segment 12.

In the embodiment according to FIG. 3 the dowel part 3*a* consists of two halves, each half being formed by two dowel segments 12. The two halves are kept together by the plugs 13 and the holes 14 or by a web at one end of the dowel segments 12.

If the furniture door 15 having a hinge whose mounting plate 5 is anchored to the side wall 2 by means of dowels 1 according to the invention is opened and turned in the direction of arrow A in FIG. 1 slightly beyond the abutment of the hinge stop, the hinge arm 6 is lifted from the mounting plate 5 in the direction of arrow K. The expansion member 4 is pulled in the same direction. By means of truncated cone sections 7 the dowel segments 12 are laterally pressed into the bore wall in the directions of arrows S, whereby the dowel 1 is anchored more securely in the side wall 2 of the piece of furniture.

The expansion member 4 can be pulled out until the projecting ring 8 abuts against the stop face 9' of the recess 9. If the door 15 is relieved of strain, the expansion member 4 and thus the mounting plate 5 are automatically pulled toward the side wall 2 and into the bore of the dowel hole.

The expansion members 4 and the mounting plate 5 are preferably made of zinc die-castings or hard plastics. The dowel parts 3 of the dowel 1 anchored in the side wall 2 of the piece of furniture are preferably made of soft plastics.

When fastening the mounting plate 5 the dowel part 3 is placed on the expansion member 4, whereupon both parts are pressed into the pre-drilled fastening hole in the furniture part.

In the case of conventional dowels the dowel part made of plastics is first inserted into the hole, and only then is the expansion member hammered into the dowel part.

The assembling method according to the invention provides the advantage that holes of different depths do not influence the fit of part 3 and, therefore, the coacting of the dowel part 3 and the expansion member 4.

In the embodiment according to FIGS. 4 through 7, the dowel 1 also comprises an expansion member 4 directly linked to the mounting plate 5 and dowel jaws or dowel segments 12 of plastics.

Figure 7:
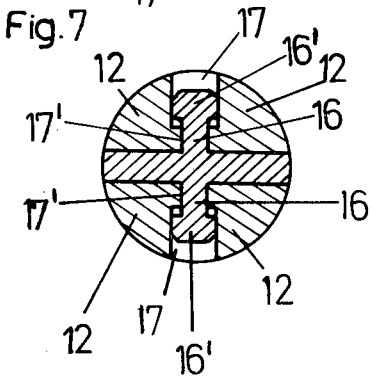
FIG. 7 is a sectional view along line VII—VII of FIG. 5.

As can particularly be seen in FIG. 7, the expansion member 4 has projections 16 which extend into longitudinal holes 17 of the dowel segments 12. Projections 16 have enlarged heads 16' which extend outwardly behind inwardly directed portions 17' in the longitudinal holes 17, thus holding the dowel segments 12 on the expansion member 4.

Figure 6:
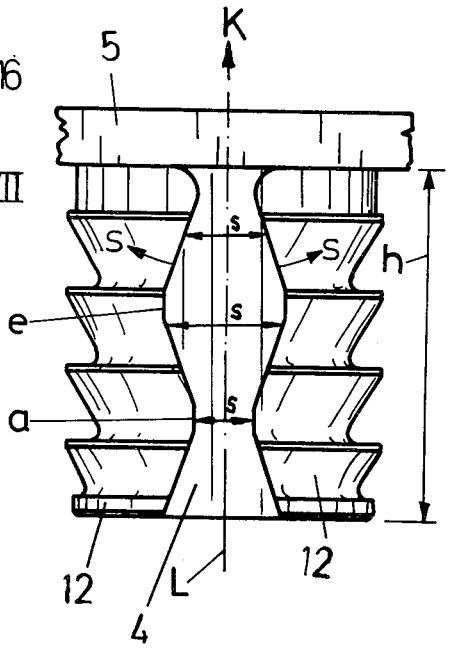
FIG. 6 is a view in the direction of arrow C of FIG. 5.

As can particularly be seen in FIG. 6, the expansion member 4 differs in width s over its height h, and the dowel segments 12 have corresponding recesses e and protrusions a which are complementary to variations in width s. If the expansion member 4 is pulled out from the side wall 2 in the direction of arrow K, this embodiment also provides still faster anchoring of the dowel 1 in the side wall 2, as the dowel segments 12 are pressed into the bore wall in the directions of arrows S.

If pressure is exerted on the expansion member in the direction of arrow K, the dowel segments 12 are compressed or stressed in the direction of height h. If the pressure stops, the dowel segments 12 expand or counter such stress and pull the expansion member 4 into the bore.

As in all other embodiments the dowel segments 12 are provided with conventional external saw-tooth shaped ribs to provide better anchoring in the side wall 2.

Figure 8:
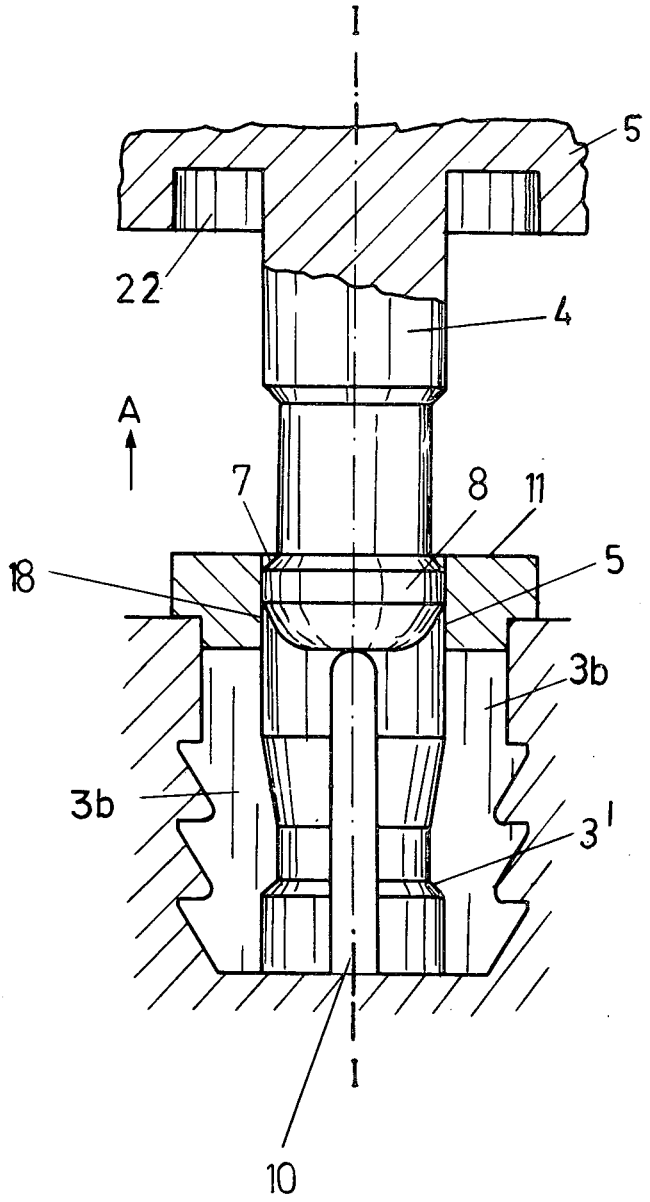
FIGS. 8 through 11 are each sectional views of further embodiments of a mounting plate according to the invention, in the area of the dowel.
Figure 9:
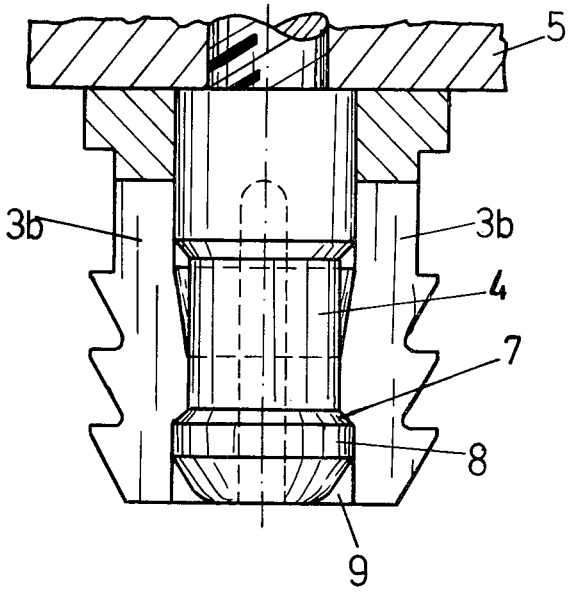

In the embodiment according to FIGS. 8 and 9 the free end of the expansion member 4 also has a projecting ring 8. Before mounting the projecting ring 8 rests against the inside surface 18 of the dowel part 3 near the upper edge 11 of the dowel part 3*b* (FIG. 8) in such a way that the dowel part 3*b* is held on the expansion member 4 by means of the clamping effect of its elastic material.

If the dowel part 3*b* and the expansion member 4 are driven into the side wall 2 the projecting ring 8 engages with the recess 9 of the dowel part 3*b*.

If the expansion member 4 and the mounting plate 5 are pulled out of the dowel part 3*b*, the truncated cone section 7 adjacent to the projecting ring 8 presses on the inclined surface 3' of the dowel part 3*b* and the dowel part 3*b* which according to this embodiment, is divided into two halves, is pressed against the wall of the bore into which it is inserted.

The mounting plate 5 has a ring-shaped recess 22 surrounding the expansion member 4 and adapted to receive the end 11 of the dowel part 3*b* on the side of the mounting plate so that a particularly secure and close fit of the dowel part 3*b* on the mounting plate 5 is provided.

Figure 10:
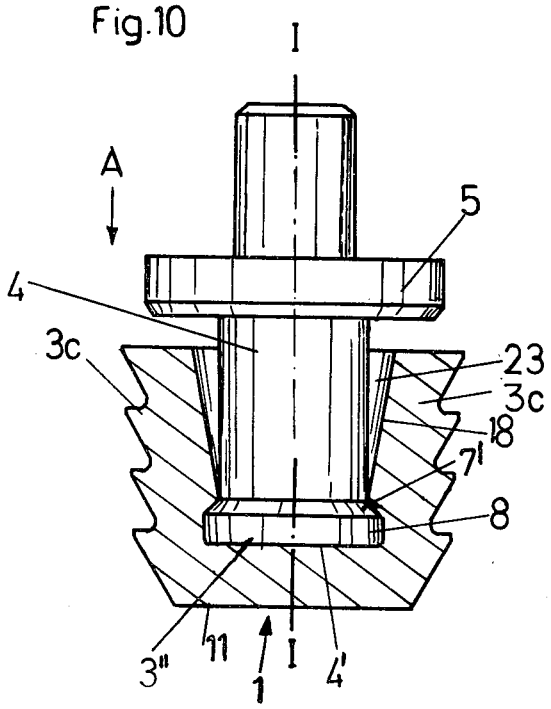

In the embodiment according to FIG. 10, the central aperture 23 of the dowel part 3*c* receiving the expansion member 4 is not continuous. Thus, when the expansion member 4 is inserted, the front face 4' of the expansion member 4 rests against a corresponding bottom face 3'' of the dowel part 3*c*. The inclined surfaces 7' on the conic expansion member 4 is immediately adjacent to the projecting ring 8. The expansion member 4 forming a part of the mounting plate 5 pushes the lower portion of the dowel part 3*c* into the side wall 2. If the mounting plate 5 is pulled out, the upper teeth of the dowel part 3*c* spread outwardly as in the other embodiments and improve the hold of the dowel part 3*c* and thus of the expansion member 4 in the side wall 2 of the piece of furniture.

Figure 11:
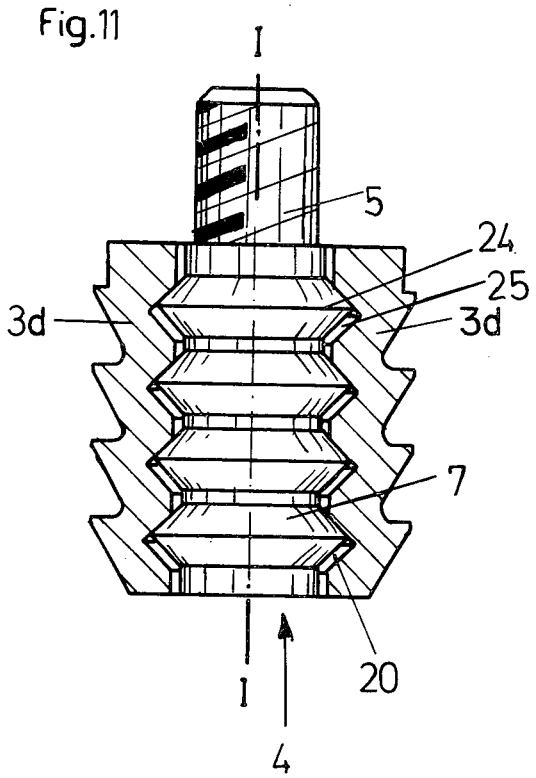

In the embodiment according to FIG. 11, the truncated cone section 7 is a spiral portion extending over the entire length of the expansion member 4 and into a corresponding recess 25 of the dowel part 3*c*.

What is claimed is:

1. A mounting plate for furniture hinges, said mounting plate being of the type adapted to be secured to a first furniture element and adapted to support a hinge arm which is hingedly connected to a second furniture element, said mounting plate comprising:

a plate member;

at least one rigid expansion member integrally and immovably fixed to said plate member and extending therefrom, said expansion member having a first axial end adjacent said plate member and a second axial end spaced therefrom;

a dowel member formed of a deformable material and having an axial opening, said expansion member extending into said axial opening, with said dowel member surrounding said expansion member, said dowel member having a first axial end and a second axial end respectively adjacent said first and second axial ends of said expansion member;

said dowel member having an exterior having outwardly extending ribs adapted to be anchored in a wall of a bore in a first furniture element when said dowel member and expansion member are inserted therein;

said expansion member being mounted within said dowel member for limited axial movement relative thereto, such that when an external force is applied to said plate member to move said plate member away from the first furniture element, said expansion member will move axially of said dowel member, in a direction from said second end thereof to said first end thereof, by a limited extent;

said dowel member having opposite interior surfaces converging from said second end to said first end of said dowel member;

said expansion member having opposite exterior surfaces, complementary to said interior surfaces, converging from said second end to said first end of said expansion member; and said interior surfaces and said exterior surfaces being dimensioned such that upon axial movement of said expansion member with respect to said dowel member, said exterior surfaces of said expansion member will bear against said interior surfaces of said dowel member, thereby deforming said dowel member and forcing said ribs further against the wall of the bore in the first furniture element.

2. A mounting plate as claimed in claim 1, wherein said ribs diverge outwardly from said second end of said dowel member to said first end thereof.

3. A mounting plate as claimed in claim 1, wherein said axial opening extends entirely through said dowel member.

4. A mounting plate as claimed in claim 1, wherein said axial opening extends only partially through said dowel member.

5. A mounting plate as claimed in claim 4, wherein said opposite interior surfaces comprise portions of an interior truncated conical surface, and said opposite exterior surfaces comprise portions of an exterior truncated conical surface.

6. A mounting plate as claimed in claim 1, wherein said opposite interior surfaces comprise portions of an interior truncated conical surface, and said opposite exterior surfaces comprise portions of an exterior truncated conical surface.

7. A mounting plate as claimed in claim 1, wherein said opposite interior surfaces comprise portions of plural truncated conical surfaces, and said opposite exterior surfaces comprise portions of plural truncated conical surfaces.

8. A mounting plate as claimed in claim 1, wherein said dowel member has therein axially extending slots opening alternately on said first and second ends of said dowel member.

9. A mounting plate as claimed in claim 1, wherein said dowel member comprises plural circumferentially extending cylindrical segments having adjacent axial edges, one of said adjacent axial edges having therein holes, the other of said adjacent axial edges having extending therefrom plugs, said plugs extending into said holes, thereby joining said segments.

10. A mounting plate as claimed in claim 1, futher comprising means for limiting said axial movement between said expansion member and said dowel member.

11. A mounting plate as claimed in claim 10, wherein said limiting means comprises a recess in said second end of said dowel member, said recess having a stop face, and an annular ring extending outwardly from said second end of said expansion member, said ring extending into said recess and adapted to abut said stop face to limit said axial movement.

12. A mounting plate as claimed in claim 11, wherein the axial dimension of said recess is greater than the axial dimension of said ring.

13. A mounting plate as claimed in claim 10, wherein said dowel member comprises first and second cylindrical segments, said opposite interior surfaces comprise first and second laterally extending interior surfaces separating said first and second segments and having a spacing therebetween which varies in the axial direction of said dowel member, and said opposite exterior surfaces comprise first and second laterally extending exterior surfaces having a spacing therebetween which varies in the axial direction of said expansion member.

14. A mounting plate as claimed in claim 13, wherein said limiting means comprises first and second axially extending slots in said first and second segments, said slots having axially opposite ends spaced from said ends of said dowel member, and projections extending outwardly from said expansion member and axially slidably positioned within said slots.

15. A mounting plate as claimed in claim 14, wherein said projections have enlarged heads, and said slots have inwardly directed portions, said heads fitting in said slots exteriorly of said inwardly directed portions, thereby holding said segments on said expansion member.

16. A mounting plate as claimed in claim 1, wherein said opposite interior surfaces comprise portions of a spiral surface extending substantially throughout the axial length of said dowel member, and said opposite exterior surfaces comprise portions of a spiral surface extending substantially throughout the axial length of said expansion member.

* * * * *